US006463770B1

(12) United States Patent
Lee

(10) Patent No.: US 6,463,770 B1
(45) Date of Patent: Oct. 15, 2002

(54) LOCK FOR A COMPUTER

(76) Inventor: Miko Lee, 3 Fl., No. 649-5, Chung Cheng Rd., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 09/897,030

(22) Filed: Jul. 3, 2001

(51) Int. Cl.[7] ..... E05B 69/00; E05B 73/00

(52) U.S. Cl. ..... 70/58; 70/57; 70/14; 70/424; 70/426; 70/428; 70/491

(58) Field of Search ..... 70/58, 57, 14, 70/491, 424, 426, 428

(56) References Cited

U.S. PATENT DOCUMENTS 1,000,962 A * 8/1911 Blais ..... 70/58
1,921,434 A * 8/1933 Stone ..... 70/58
3,631,896 A * 1/1972 Meigs ..... 138/89
4,154,071 A * 5/1979 Castle ..... 70/424
4,964,285 A * 10/1990 Lakoski et al. ..... 70/14
4,970,883 A * 11/1990 Johnson ..... 70/30
5,050,413 A * 9/1991 Stillwagon et al. ..... 70/386
5,197,314 A * 3/1993 Stillwagon et al. ..... 70/386
5,289,704 A * 3/1994 Johnson ..... 70/30
5,327,752 A * 7/1994 Myers et al. ..... 70/58
5,829,280 A * 11/1998 Chen ..... 70/49
5,868,014 A * 2/1999 Lee ..... 70/58
5,913,907 A * 6/1999 Lee ..... 70/58
6,058,744 A * 5/2000 Ling ..... 70/28
6,199,413 B1 * 3/2001 McDaid et al. ..... 70/58
6,205,824 B1 * 3/2001 Miao ..... 70/58
6,227,016 B1 * 5/2001 Yu ..... 70/30
6,227,017 B1 * 5/2001 Igelmund ..... 70/58
6,244,080 B1 * 6/2001 Sakurai ..... 70/14
6,244,082 B1 * 6/2001 Avganim ..... 70/58
6,305,197 B1 * 10/2001 Ling ..... 70/30

FOREIGN PATENT DOCUMENTS

FR 1396563 * 3/1965 ..... 70/58

* cited by examiner

*Primary Examiner*—J. J. Swann
*Assistant Examiner*—Carlos Lugo
(74) *Attorney, Agent, or Firm*—Rosenberg, Klein & Lee

(57) ABSTRACT

A lock for a computer has a housing, a core pivotally mounted to the housing, a latch formed on and extending out of the core, a rod coupled to the core. The rod has a flange end and a pair of pins extending from the flange end. A spring is disposed around the rod to provide a resilience to the pins, and a cable is pivotally connected to the housing. A case of the computer has a latch chamber and an entrance communicates with the latch chamber to allow the latch and the pin to enter the latch chamber through the entrance.

6 Claims, 10 Drawing Sheets

LOCK FOR A COMPUTER

BACKGROUND OF THE INVENTION

1. Field of the Invention

The present invention relates to a lock, and more particularly to a lock for a computer which is convenient to operate and has a simple structure.

2. Description of Related Art

With the rapid growth of computer technology, computers today have a relatively compact size and lighter weight than computers of earlier times, especially for those of portable computers. This improvement in size and weight makes a modern computer easy to be carried around but also easy for thief to steal. Loss of the computer may be serious not just because of its cost but particularly because files stored in the computer may be important.

To secure the computers, a conventional lock for the computer is presently available in the market. The conventional lock for the computer includes a lock body having a latch extending from the lock, a latch hole defined in a case of a computer, and a cable having an end securely connected to the lock body and the other end formed in a loop. In operation, the loop of the cable is reeved around an immovable object, and the latch is received in the latch hole. A user has to rotate the housing to rotate the latch in the latch hole to pre-lock the latch, and then finish the locking procedure by changing a combination or switching a key. This two-step locking procedure is not convenient enough and needs to be further simplified. Moreover, the cable used to connect the computer to the immovable object may become kinked and the kinking of the cable causes inconvenience to the user.

To overcome the shortcomings, the present invention tends to provide an improved lock for a computer to mitigate or obviate the aforementioned problems.

SUMMARY OF THE INVENTION

The objective of the present invention is to provide a lock for a computer which is easy to operate.

Another objective of the present invention is to provide a lock for a computer in which the kinking of a cable of the lock is prevented.

Another objective of the present invention is to provide a lock for a computer which has a simple structure.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
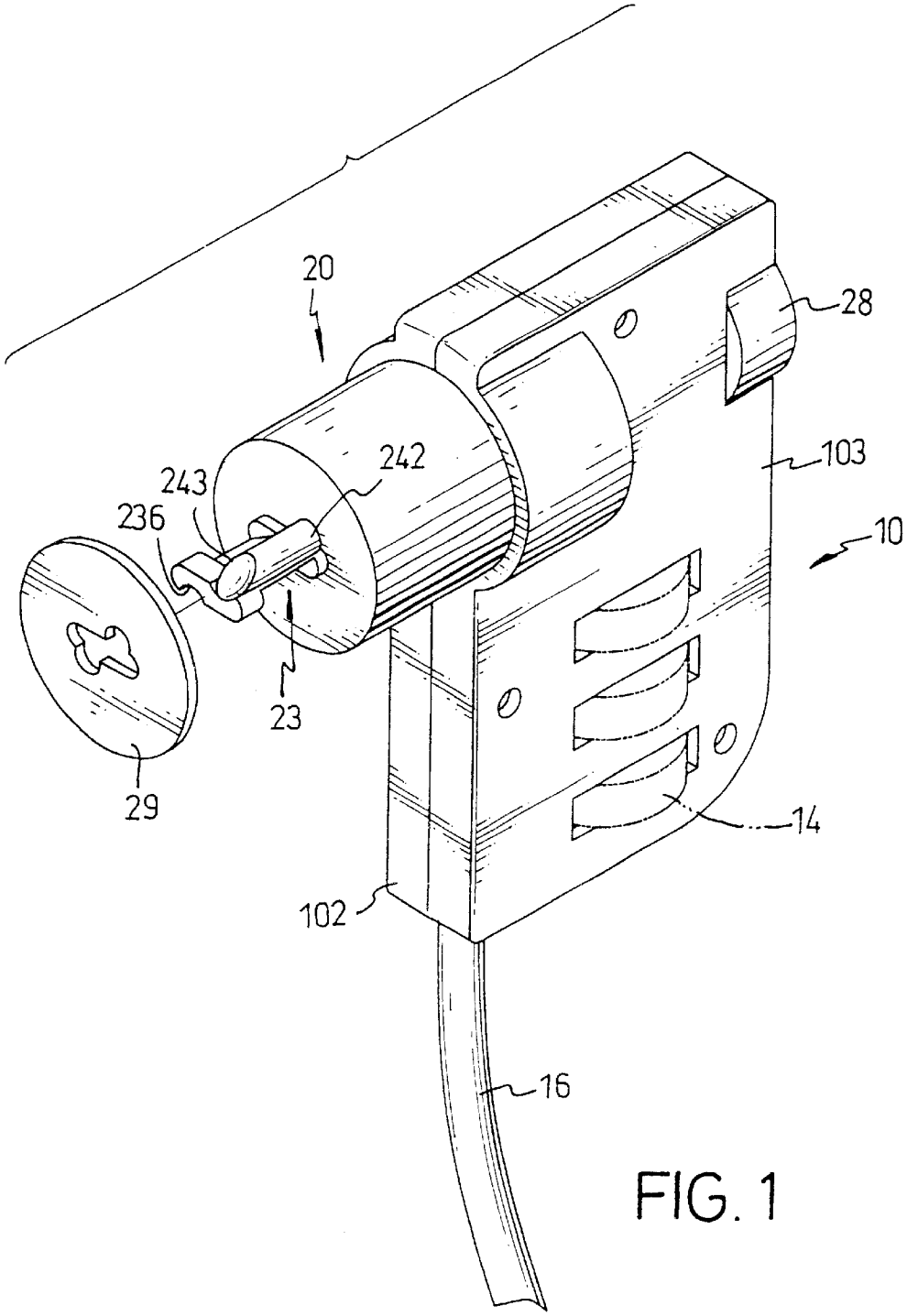
FIG. 1 is a perspective view of a lock for a computer in accordance with the present invention.
Figure 2:
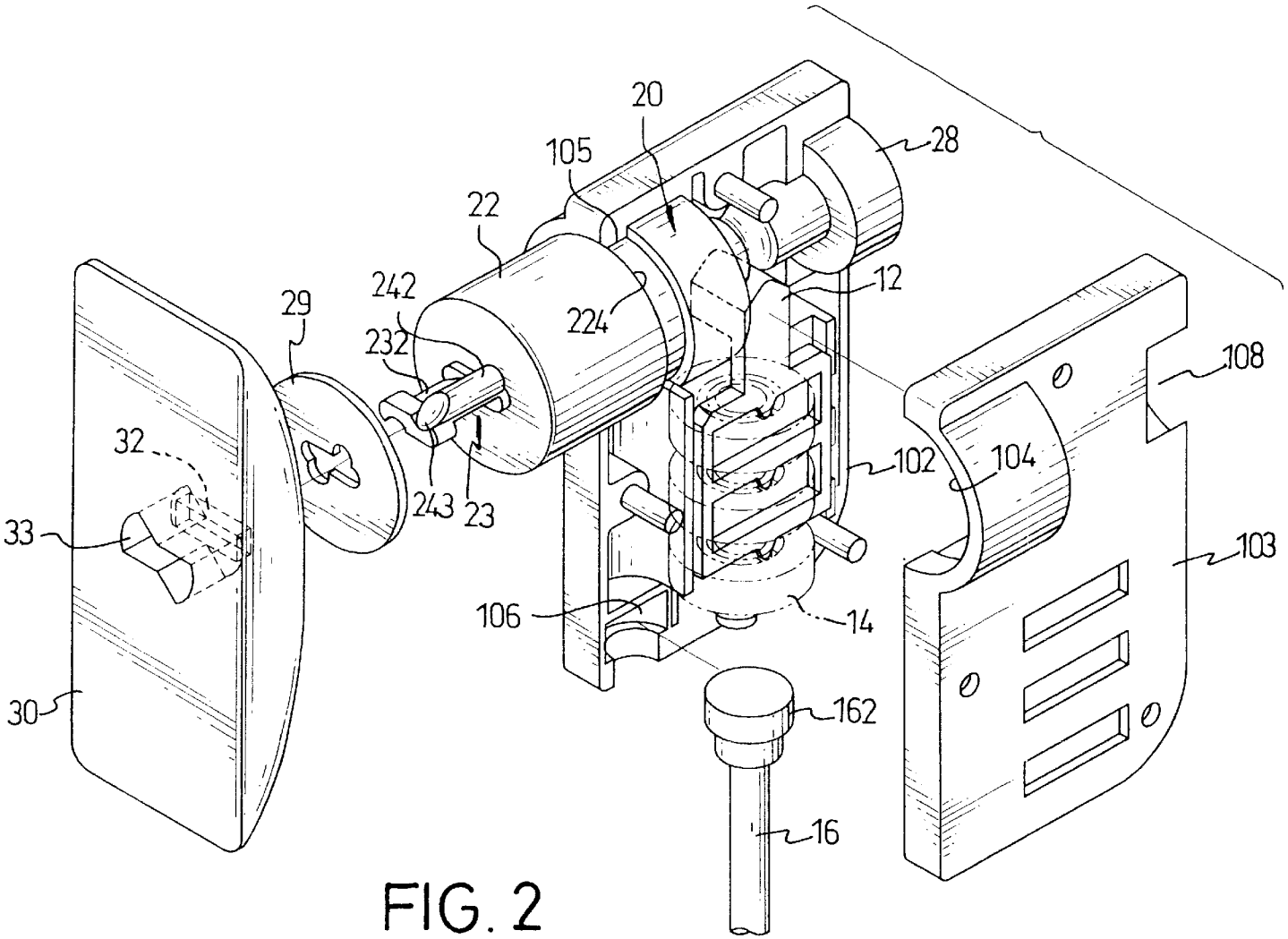
FIG. 2 is an exploded, perspective view of the lock for the computer.

With reference to FIGS. 1 and 2, a lock for a computer in accordance with the present invention has a housing (10), a core (20) protruding from the housing (10), a rod (24 shown in FIG. 3) coupled to the core (20), a locking mechanism (14) disposed in the housing (10), a cable (16) pivotally connected to the housing (10), and a latch hole (33) defined in a case (30) of the computer.

The housing (10) is formed by assembling two symmetric pieces (102 and 103). A chamber (104) for receiving the core (20) is defined in an upper front portion of the housing (10) and the chamber (104) has a front opening (not numbered) to allow the core (20) to protrude therethrough.

Figure 3:
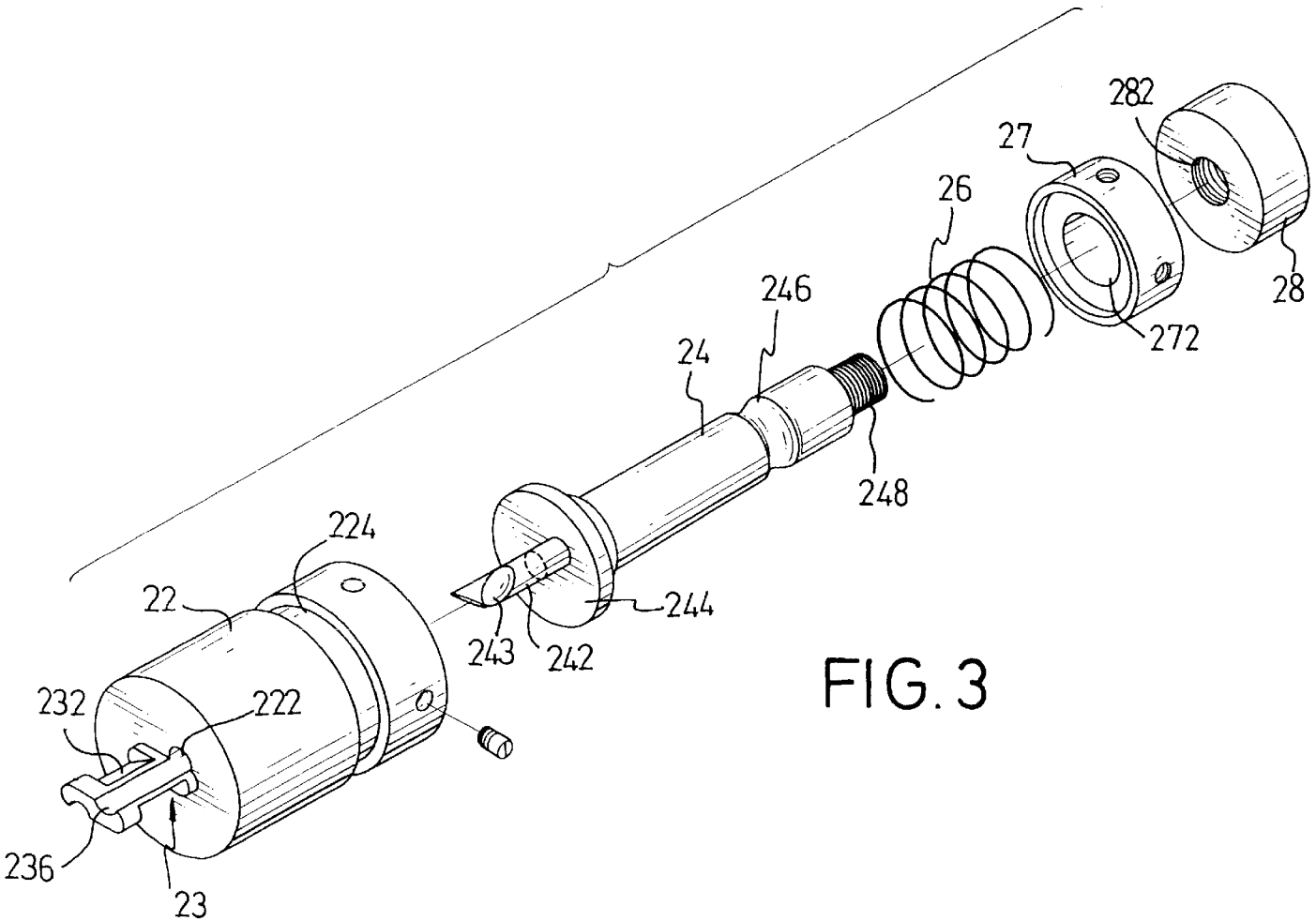
FIG. 3 is an exploded, perspective view of a core and a rod of the lock for the computer.
Figure 4:
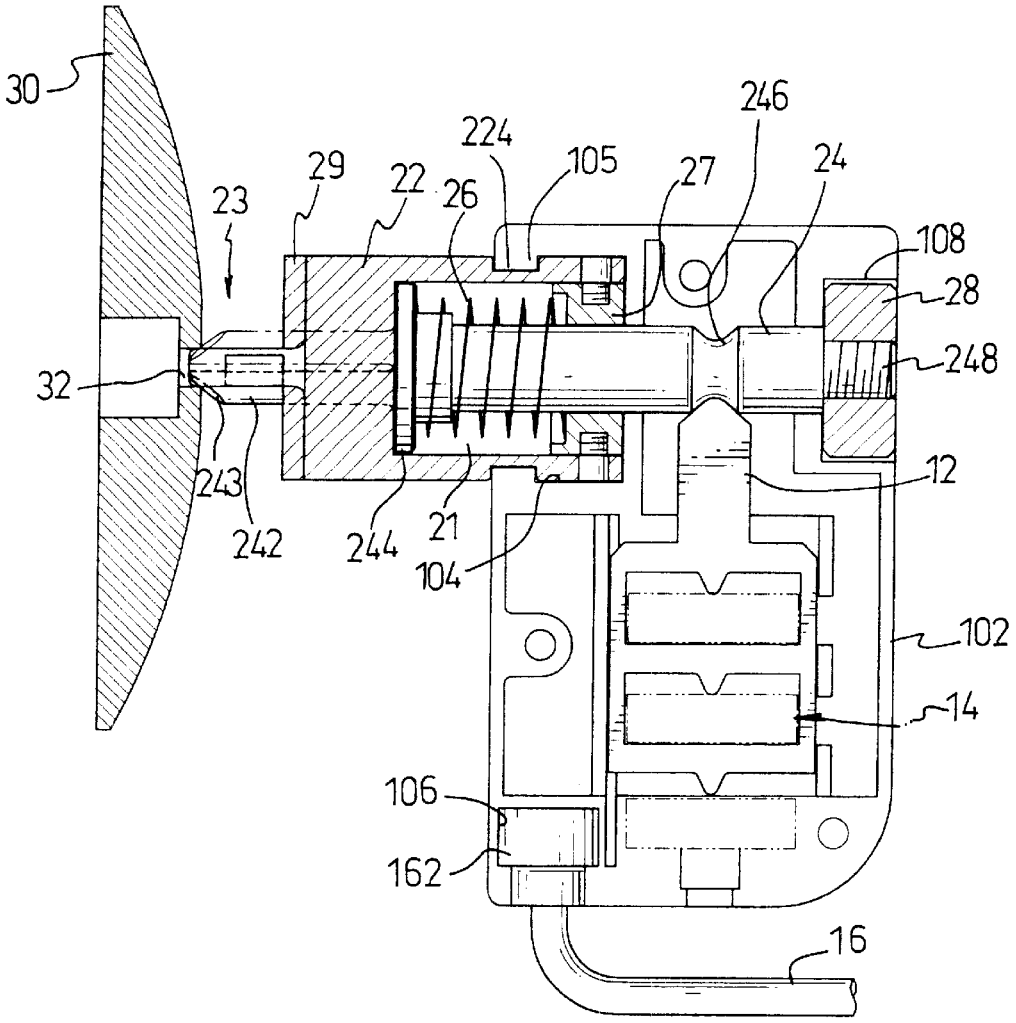
FIG. 4 is a cross-sectional view of the lock for the computer showing a condition when a latch is entering a latch hole.

With reference to FIGS. 3 and 4, the core (20) has a rod hole (21) defined therein and a latch (23) integrally mounted on a closed end of the core (20) opposed to the rod hole (21). The latch (23) has a pair of slopes (232) and a pair of sliding slots (236). The slopes (232) are formed parallel to each other. A pair of pin holes (222) corresponding to the sliding slots (236) is defined in the closed end of the core (20) and the pin holes (222) communicate the sliding slots (236) and the rod hole (21).

The rod (24) has a flange end (244), a stud end (248), and a restricting slot (246) defined in between the flange end (244) and the stud end (248). A pair of pins (242) each having a sharp point (243) and so configured to be able to respectively extend through the pin holes (222) is integrally mounted on the flange end (244) and extending outwardly.

The flange end (244) of the rod (24) is received in the rod hole (21), and at the same time, the slot (246) and the stud end (248) extend out of the stud hole (21). The pins (242) are able to be respectively protruding from the corresponding pin hole (222) and slidingly lie in the sliding slots (236). A spring (26) is disposed around the rod (24) and has a first end that abuts the flange end (244), and a second end. A cap (27) with a through hole (272) centrally defined therein partly covers the rod hole (21), with the rod (24) extending through the through hole (272), and the cap (27) is connected to the core (20) using threading means. By such an arrangement, the pins (242) are retractable and have a resilience provide by the first and second ends of the spring (26) being respectively sandwiched between the flange end (244) and the cap (27). A button (28) having a thread hole (282) is mounted onto the rod (24) by mating of the stud end (248) and the thread hole (282).

Figure 9:
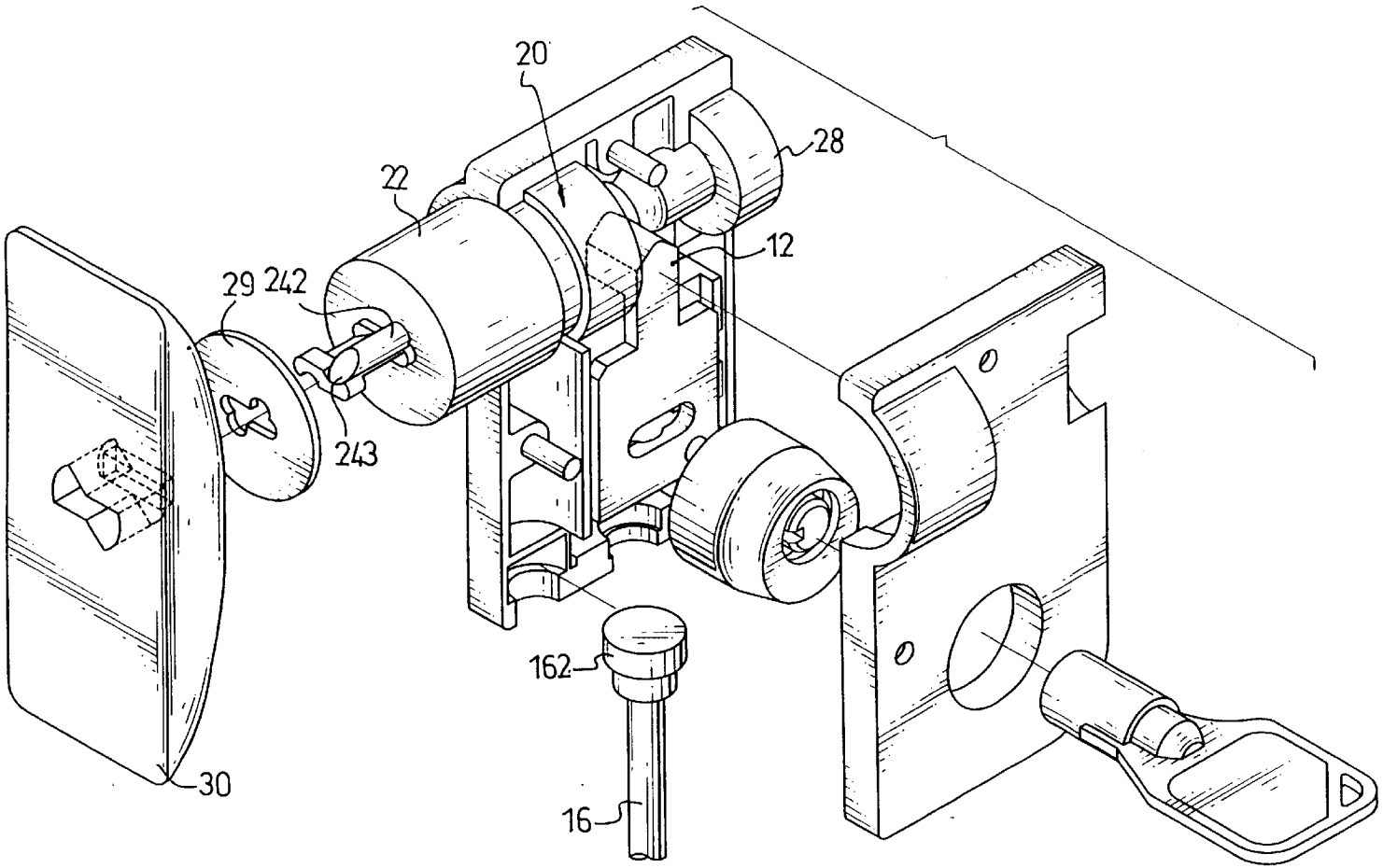
FIG. 9 is an exploded, perspective view of the lock for the computer, wherein the locking mechanism is a key type mechanism.
Figure 10:
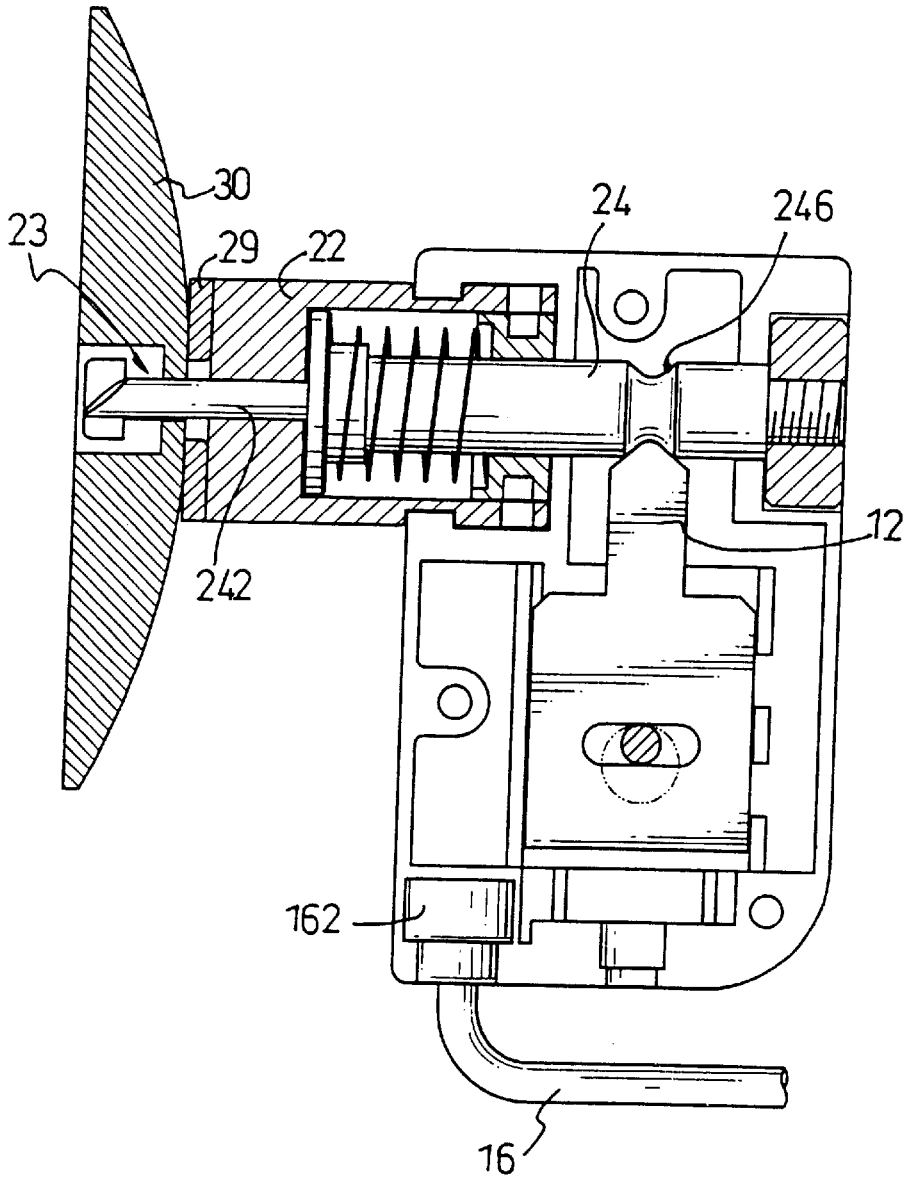
FIG. 10 is a cross-sectional view of the lock for the computer showing a condition when the latch is received in the latch hole, wherein the locking mechanism is the key type mechanism of FIG. 9.
Figure 11:
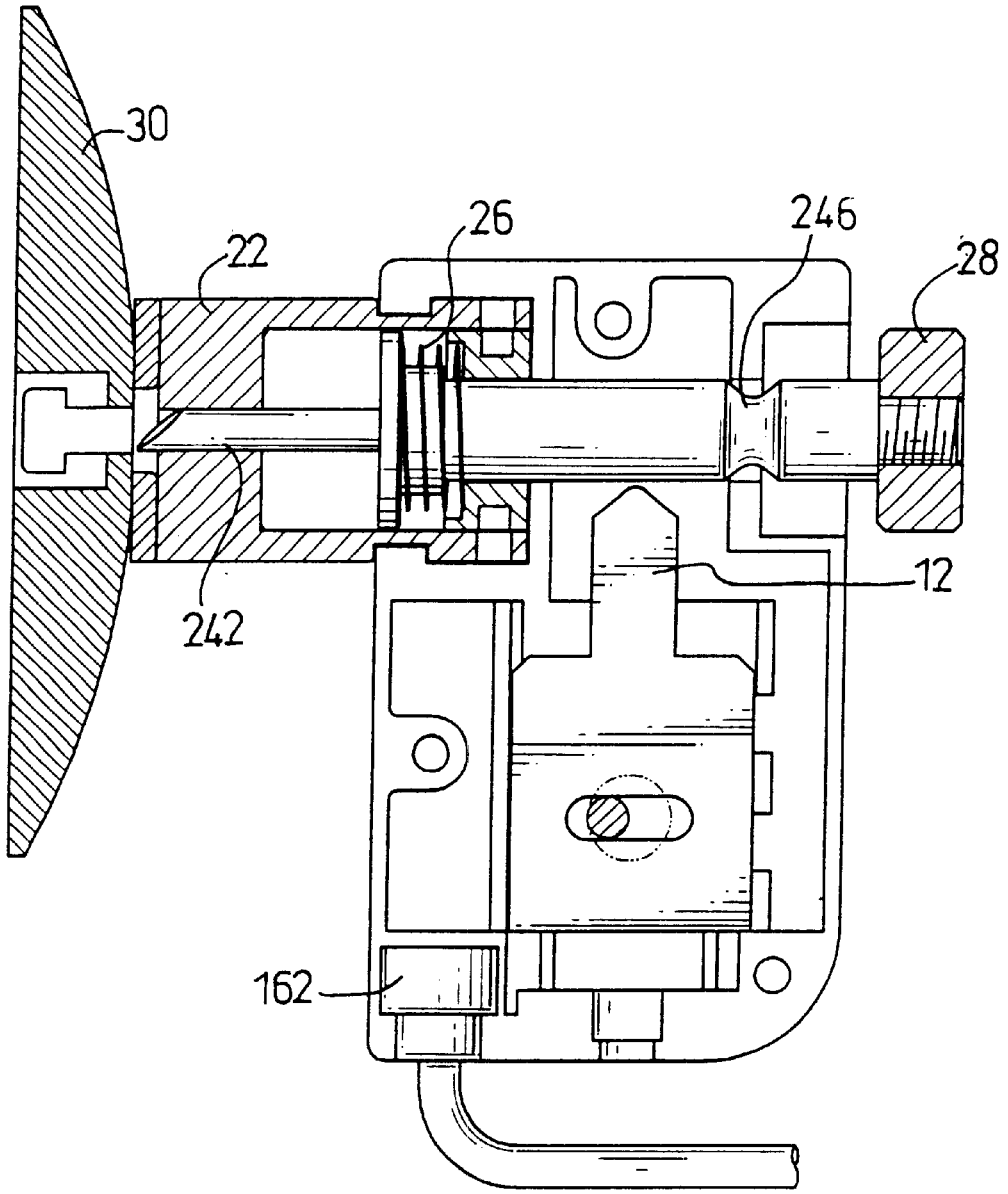
FIG. 11 is a cross-sectional view of the lock for the computer showing a condition when the latch is withdrawing from the latch hole, wherein the locking mechanism is the key type mechanism of FIG. 9.

Still referring to FIG. 4, the locking mechanism (14) has a peg (12) moveably extending upwardly from a top of the locking mechanism (14). The peg (12) has a V-top to slidingly mate with the restricting slot (246). Although in the preferred embodiment the peg top and the slot are V-shaped, it is to be appreciated that other configurations are practical. The locking mechanism (14) may be of a combination type locking mechanism as shown in the figures or a key type locking mechanism (as shown in FIGS. 9-11). The locking mechanism (14) and its operation are known in the field thus are not described in further detail.

The core (20) coupled with the rod (24) is received in the chamber (104) with a head portion (22) of the core (20) protruding out of the chamber (104) through the front opening. The core (20) is restricted in the chamber (104) and rotatable with respect to the housing (10) due to a circumferential groove (224) of the core (20) receiving a retaining flange (105) formed on a periphery defining the front opening of the chamber (104). The button (28) is received in a socket (108) defined in an upper rear portion of the housing (10). The locking mechanism (14) is disposed in the housing (10) and with the peg (12) upwardly extendable into the restricting slot (246).

The cable (16) has a knob (162) securely mounted in an end of the cable (16), and the other end of the cable (16) forms a loop (not shown). The cable (16) and the housing (10) are pivotally connected together by receiving and restricting the knob (162) in a countersunk bore (106) defined in a bottom forward portion of the housing (10). By receiving the knob (106) in the countersunk bore (106), the cable (16) and the housing (10) are securely connected together and the cable (16) is rotatable with respect to the housing (10) to prevent kinking of the cable (16).

Referring to FIGS. 2 and 4, the latch hole (33) defined in the case (30) of the computer has an entrance (32). The entrance (32) is slightly larger than the latch (23) so that the latch (23) is allowed to extend therethrough. The latch hole (33) is configured such that it is able to receive the latch (23) and the pins (242) lying on the sliding slots (236) of the latch (23).

With reference to FIGS. 2, 4, 5, and 6, when in a securing first mode, the cable (16) is looped to an immovable object (not shown). A protecting washer (29), which is made of an elastic material, is disposed around the latch (23) to protect the case (30) of the computer being scraped by the core (20). The locking mechanism (14) is set at a correct combination so that the peg (12) of the locking mechanism (14) is able to move towards the bottom portion of the housing (10) and thus the rod (24) is not restricted by the peg (12). The latch (23) extends in the entrance (32) with the pins (242) abutting a periphery defining the entrance (32), due to the spring (26) urging the flange end (244) out of the housing (10), whereby the latch (23) further extends through the entrance (32) and into the latch hole (33), such that the pins (242) abutting the periphery will be forced to retract into the pin holes (222). After the latch (23) is fully extended into the latch hole (33), and due to the sharp points (243) of the pins (242) and the resilience provide by the spring (26), the core (20) will rotate in a certain degree such that the slopes (232) will be fitted in the entrance (32) and the pins (242) protrude into the latch hole (33) through the entrance (32). By changing the combination of the locking mechanism, the V-top of the peg (12) now received in the restricting slot (246) will restrict the rod (24) from sliding backward and so prevent withdrawal of the pins (242) out of the latch hole (33). The latch (23) and the pins (242) are secured in the latch hole (33) thus the computer is secured to the immovable object and can not be taken away.

Figure 7:
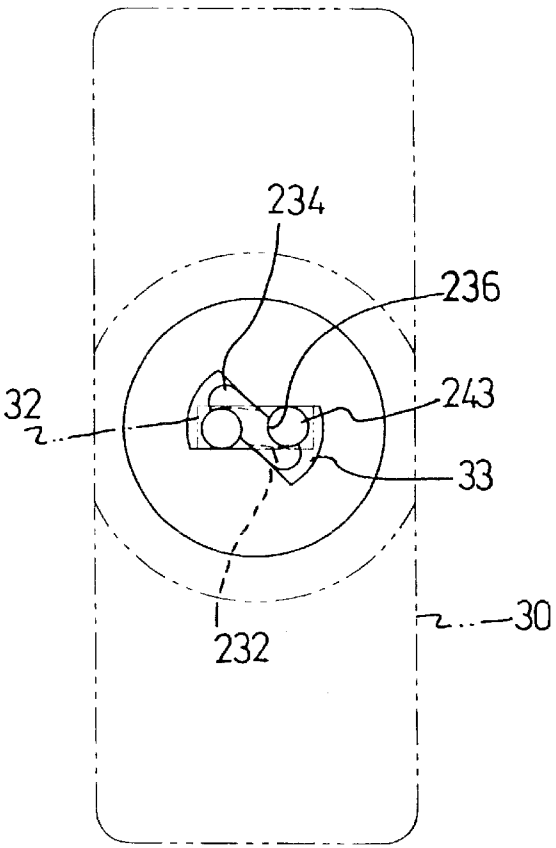
FIG. 7 is a front view of the lock for the computer showing the condition shown in FIG. 6.
Figure 5:
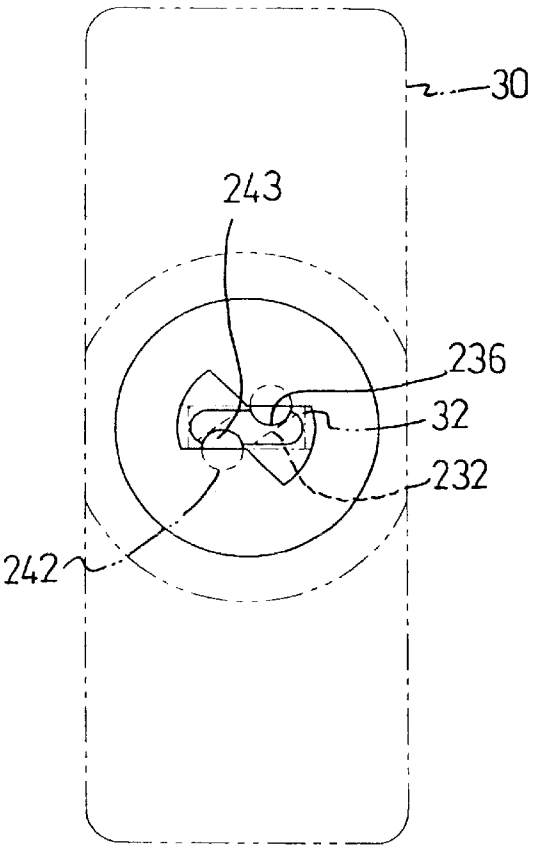
FIG. 5 is a front view of the lock for the computer showing the condition shown in FIG. 4.
Figure 6:
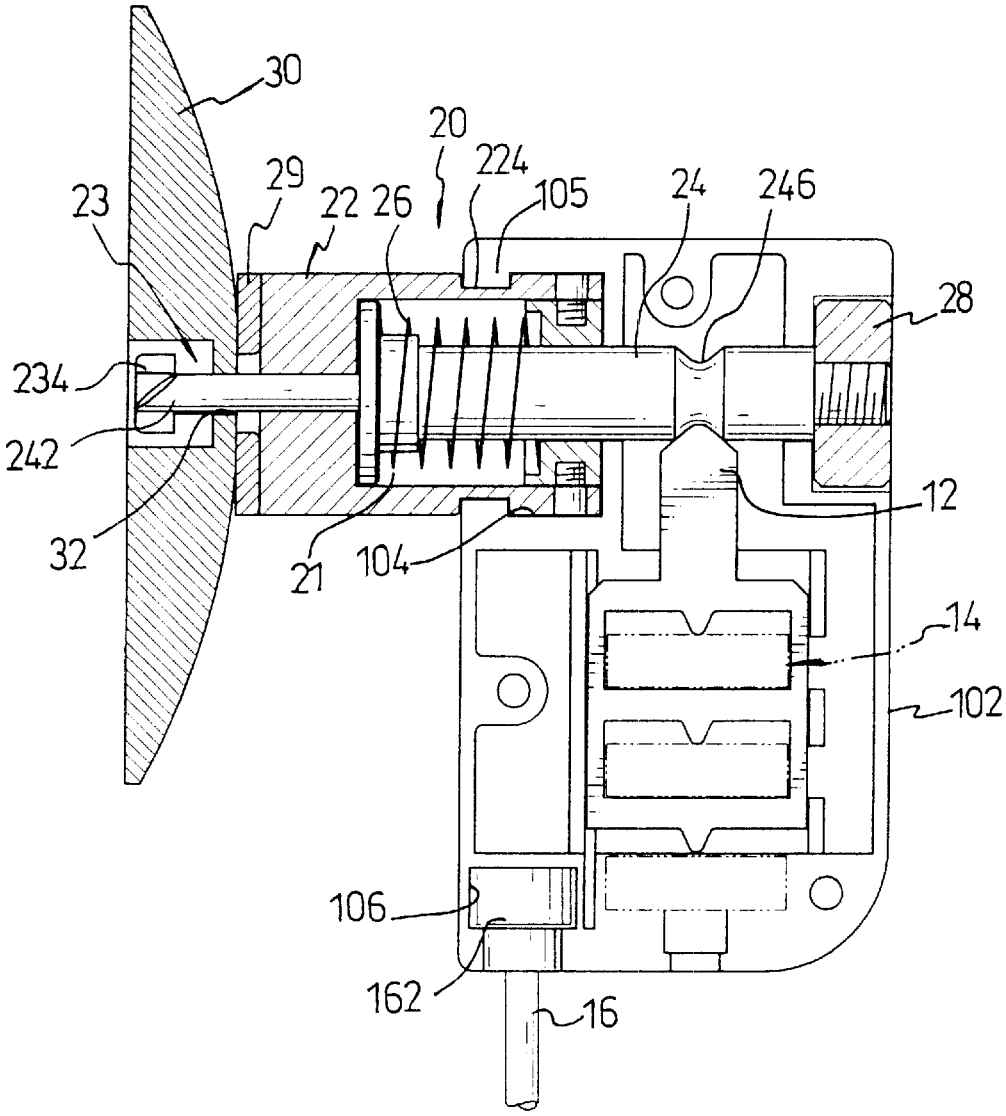
FIG. 6 is a cross-sectional view of the lock for the computer showing a condition when the latch is received in the latch hole.
Figure 8:
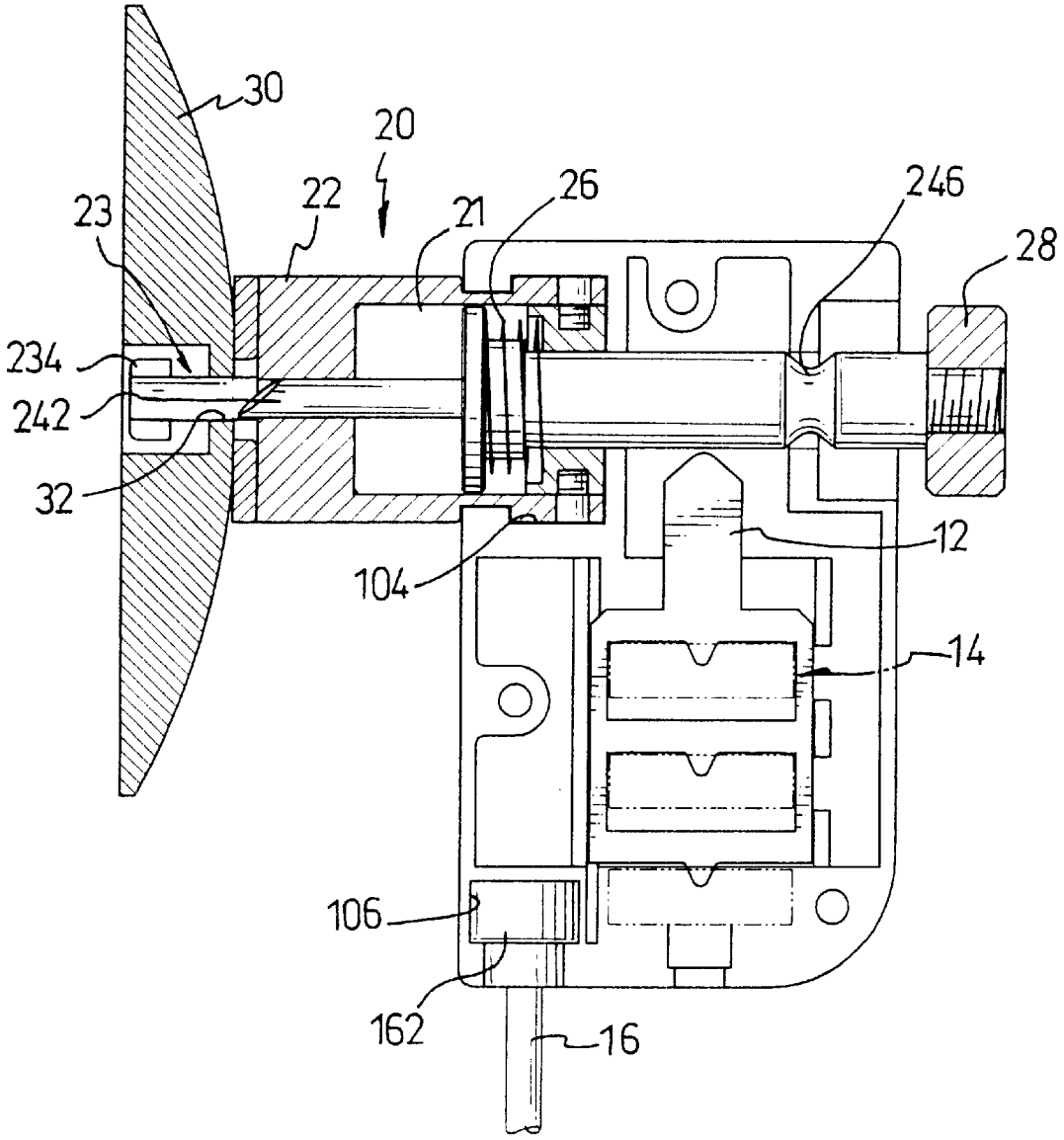
FIG. 8 is a cross-sectional view of the lock for the computer showing a condition when the latch is withdrawing from the latch hole.

With reference to FIGS. 7 and 8, to achieve an unlocked second mode, the locking mechanism (14) is set to the correct combination and the peg (12) of the locking mechanism (14) is free to move towards the bottom portion of the housing (10). Thus, the button (28) can be pulled away from the socket (108) to withdraw the pins (242) out of the case (30). With the pins (242) no longer received in the latch hole (33) and the entrance (32), the space once occupied by the pins (242) in the latch hole (33) is able to provide a space for the latch (23) to rotate to a position that aligns with the entrance (32), and the latch (23) is able to withdraw out of the latch hole (33) through the entrance (32), whereby the computer and the lock are separable.

From the above description, it is noted that the invention has the following advantages:

1. The core (20) is rotatable with respect to the housing (10) such that when using the lock to lock the computer, a user only needs to align the latch (23) to the entrance (32) to extend the latch (23) into the latch hole (33), and the core (20) will rotate automatically to adjust both the slopes (232) to be fitted in the entrance (32) and the pins (242) to protrude into the latch holes (33).
2. The cable (16) is rotatable with respect to the housing (10) such that kinking of the cable (16) is prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock for a computer, the lock comprising:

a housing;

a core rotatably connected to the housing and having a closed end with a pair of pin holes defined in the closed end and an open end opposite to the closed end and provided with a rod hole defined in the open end;

a latch integrally extending out from the closed end of the core and having a pair of slopes parallelly formed to each other on the latch and a pair of sliding slots defined in the latch, wherein each sliding slot aligned and communicated with a corresponding one of the pin holes;

a rod movably received in the housing and having:

a flange end received in the rod hole;

a pair of pins integrally formed on the flange end to extend out from the pin hole and rest on the sliding slots of the latch, wherein each of the pair of pins has a sharp point at a free end of the pin;

a stud end opposed to the flange end; and a restricting slot peripherally defined between the flange end and the stud end, a spring compressibly mounted around the rod and abutting the flange end of the rod with one end of the spring;

a cap abutted the other end of the spring and centrally defining a through hole to allow the extension of the rod;

a button securely connected with the stud end of the rod;

a locking mechanism disposed in the housing, the locking mechanism having a peg movably extending from the locking mechanism, the peg being receivable in the restricting slot of the rod to be able to restrict a movement of the rod;

a latch chamber defined in a case of the computer, and an entrance defined in the case of the computer and communicating with the latch chamber; wherein the entrance is defined corresponding to the latch and the latch chamber is greater in size in relation to the entrance; and a cable pivotally connected to the housing.

2. The lock as claimed in claim 1, wherein the locking mechanism is of a combination type.

3. The lock as claimed in claim 1, wherein the locking mechanism is of a key type.

4. The lock as claimed in claim 1, wherein a protecting washer is disposed around the latch to protect a scraping of the case of the computer by the core.

5. The lock as claimed in claim 1, wherein the housing defines a socket to receive the button.

6. The lock as claimed in claim 1, wherein the peg is formed with a V-top and the restricting slot of the rod is accordingly V-shaped to mate with the V-top of the peg.

* * * * *